US005971448A

United States Patent [19]

Hayakawa et al.

[11] Patent Number: 5,971,448

[45] Date of Patent: Oct. 26, 1999

[54] DOOR LOCK ASSEMBLY FOR AUTOMOTIVE VEHICLES

[75] Inventors: Shigeru Hayakawa, Chiryu; Norikazu Kobayashi, Chita; Katsutoshi Fukunaga, Chiryu; Katsuaki Kadoike, Kariya, all of Japan

[73] Assignee: Aisin Seiki Kabushiki Kaisha, Kariya, Japan

[21] Appl. No.: 09/061,040

[22] Filed: Apr. 16, 1998

[30] Foreign Application Priority Data

Apr. 17, 1997 [JP] Japan ..... 9-100482

[51] Int. Cl.[6] ..... E05C 3/06

[52] U.S. Cl. ..... 292/216; 292/DIG. 23; 292/DIG. 62

[58] Field of Search ..... 292/DIG. 62, DIG. 23, 292/DIG. 27, DIG. 30, 216, 201

[56] References Cited

U.S. PATENT DOCUMENTS

| | | | |
|---|---|---|---|
| 3,695,662 | 10/1972 | Ploughman | 292/216 |
| 4,334,704 | 6/1982 | Yamada | 292/216 |
| 4,735,447 | 4/1988 | Kleefeldt | 292/216 |
| 5,046,769 | 9/1991 | Rimbey et al. | 292/216 |
| 5,277,461 | 1/1994 | Dzurko et al. | 292/216 |
| 5,762,384 | 6/1998 | Bartel | 292/216 |
| 5,803,515 | 9/1998 | Arabia, Jr. et al. | 292/216 |

FOREIGN PATENT DOCUMENTS 7-54528 2/1995 Japan .

*Primary Examiner*—Darnell M. Boucher
*Assistant Examiner*—John B. Walsh
*Attorney, Agent, or Firm*—Burns, Doane, Swecker & Mathis, LLP

[57] ABSTRACT

A door lock assembly has a slide pin (9) slidably supported to an door opening lever (4), a first oblong hole (52) formed in a locking lever (5) and inserting the slide pin (9), and a window like opening (31) formed in the lift lever (3), inserting the slide pin (9) and provided with a projection (31*a*) capable of restricting a slide motion of the slide pin (9), wherein a position of the slide pin (9) with respect to the opening (31) is changed in correspondence to an operation of the door opening lever (4) and the locking lever (5), thereby engaging and disengaging the pawl (7) with the latch (6), and engaging and disengaging a connection between the door opening lever (4) with the lift lever (3).

10 Claims, 5 Drawing Sheets

DOOR LOCK ASSEMBLY FOR AUTOMOTIVE VEHICLES

BACKGROUND OF THE INVENTION

The present invention relates to a door lock assembly for a vehicle with a key less door lock mechanism which can lock a vehicle door by an operation of a lock knob without a key operation, and can perform an operation of the lock knob only at a time of performing an opening operation of the door.

An example of a door lock assembly of this type is disclosed in Japanese Patent Laid-open Publication No. 7-54528. This is constructed such as to include a door opening lever which can be associated with a lift lever so as to engage and disengage a pawl with a latch and a locking lever for establishing and releasing a lock state of the door.

In this conventional assembly, an opening is formed in the door opening lever and a oblong hole is also formed in the lift lever, and a slide pin inserting the opening and the oblong hole is connected to the locking lever through the link, so that a position of the slide pin with respect to the opening is changed in accordance with the operation of the door opening lever and the locking lever, thereby engaging and disengaging the pawl and the latch with each other and engaging and disengaging the connection between the door opening lever and the lift lever.

However, in accordance with the conventional assembly mentioned above, since the slide pin is supported to the locking lever, a link for connecting the slide pin and the locking lever is required in order to allow the slide pin to move in correspondence to the rotational operation of the door opening lever. Accordingly, a number of the parts are increased, so that it is disadvantageous in cost. Further, it is necessary to dispose the connecting portion between the locking lever and the link on a pivot of the door opening lever and the lift lever, so that it is disadvantageous in saving space.

SUMMARY OF THE INVENTION

Accordingly, an object of the invention is to provide a door lock assembly for a vehicle which restricts and allows an operation of a locking lever in correspondence to an operation state of a door opening lever by employing a simple structure having a reduced number of parts.

In order to achieve the object mentioned above, in accordance with the invention, there is provided a door lock assembly for a vehicle comprising a slide pin slidably supported to an door opening lever, a first oblong hole formed in a locking lever and inserting the slide pin, and a window like opening formed in the lift lever, inserting the slide pin and provided with a projection capable of restricting a slide motion of the slide pin, wherein a position of the slide pin with respect to the window like opening is changed in correspondence to an operation of the door opening lever and the locking lever, thereby engaging and disengaging the pawl with the latch, and engaging and disengaging a connection between the door opening lever with the lift lever.

In accordance with the technical measure mentioned above, the slide pin is inserted into the first oblong hole formed in the locking lever and the window opening formed in the lift lever in the fashion that it is directly supported on the door opening lever. Accordingly, the link for supporting the slide pin which has been required in the conventional art is not required in the present invention, so that a door lock assembly for a vehicle having a more simple structure can be obtained.

It is more preferable to further include a second oblong hole formed in the door opening lever and supporting the slide pin in such a manner that a slide motion of the slide pin with respect to the door opening lever is allowed within a rotational range of the locking lever, and a through hole formed in the door opening lever in such a manner as to communicate with the oblong hole and receiving the slide pin out of the rotating range of the locking lever.

DESCRIPTION OF THE PREFERRED EMBODIMENT

Figure 1:
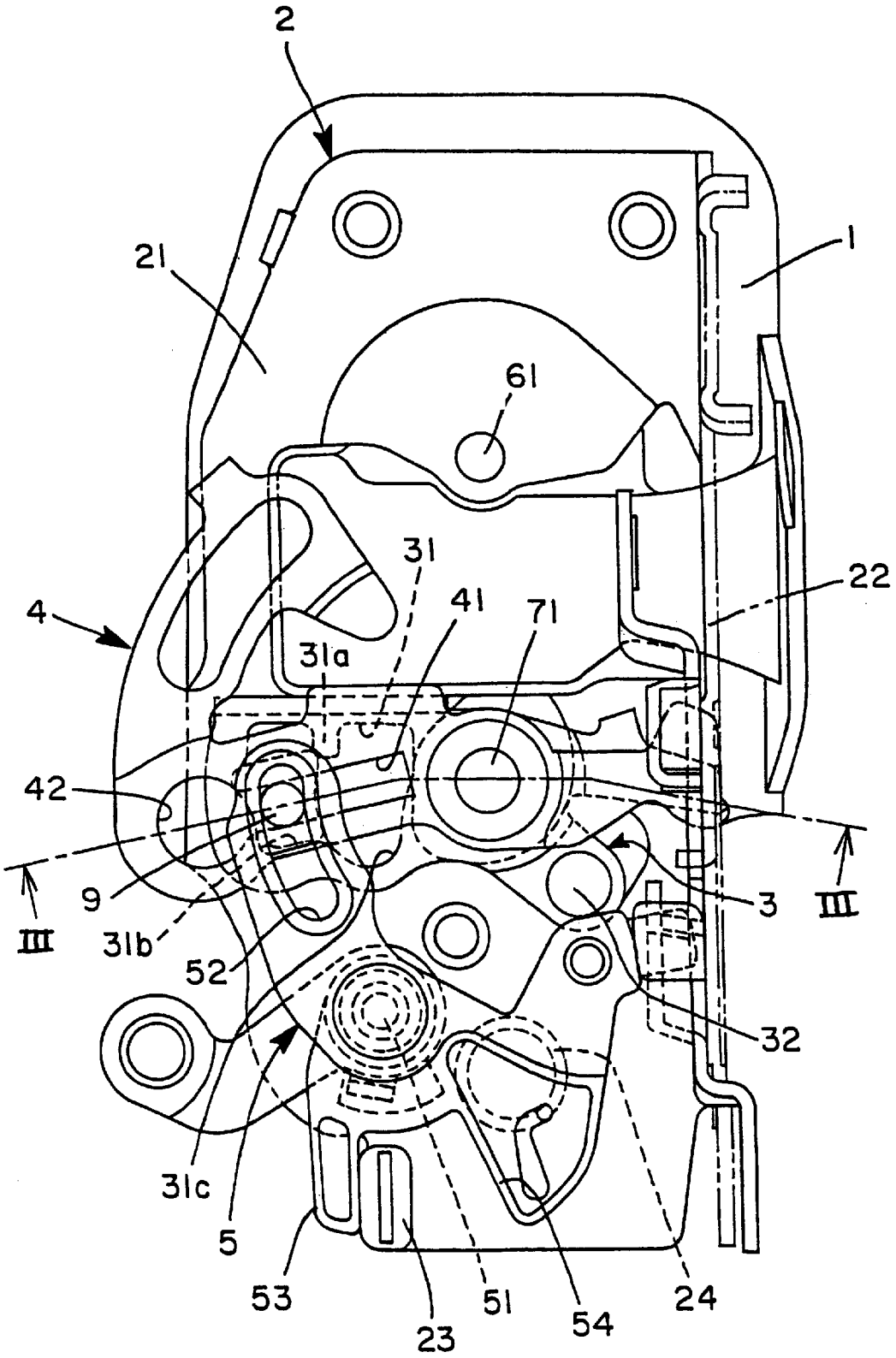
FIG. 1 is a front elevational view which shows a door lock assembly for a vehicle in accordance with the invention.
Figure 2:
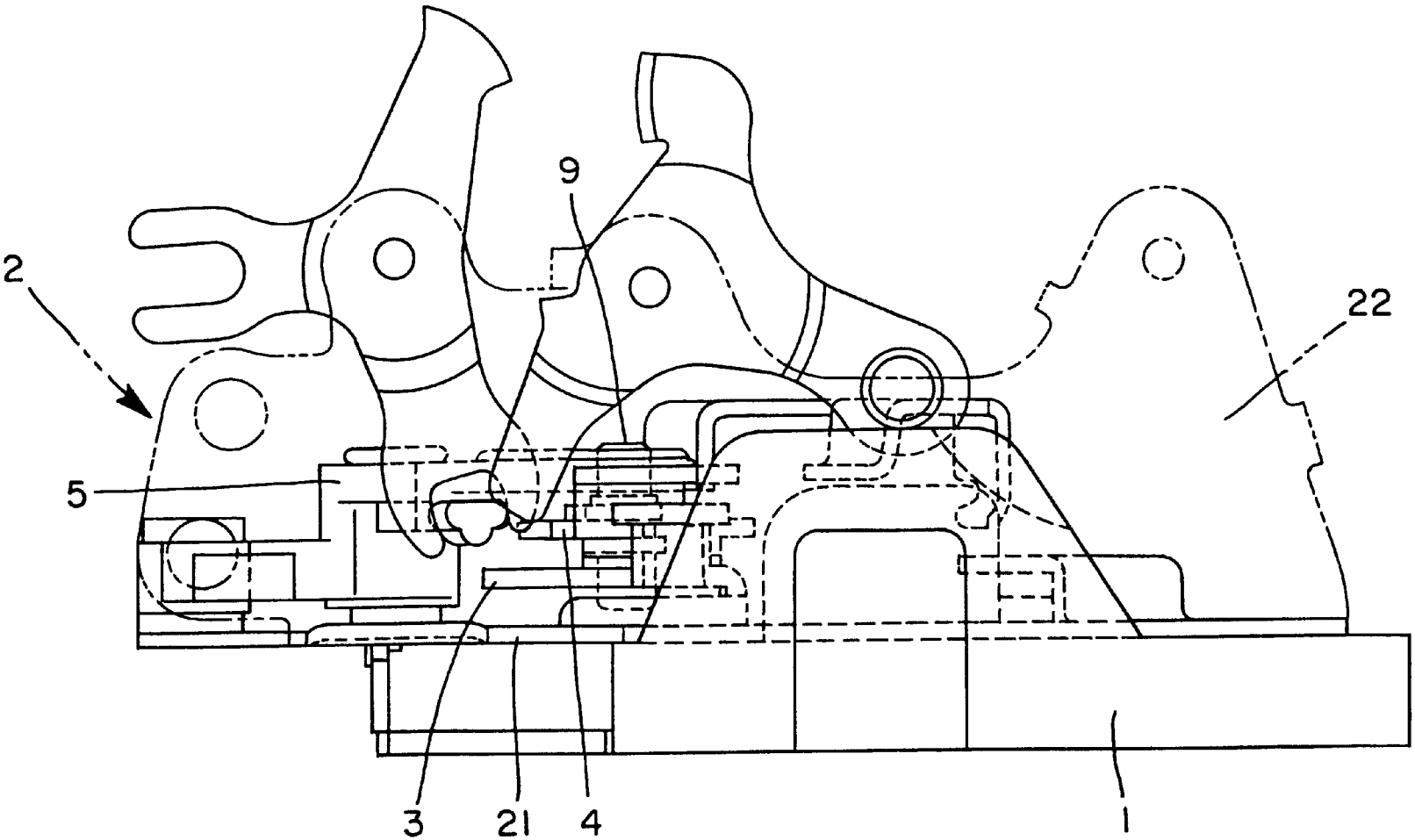
FIG. 2 is a side elevational view which shows a door lock assembly for a vehicle in accordance with the invention.
Figure 3:
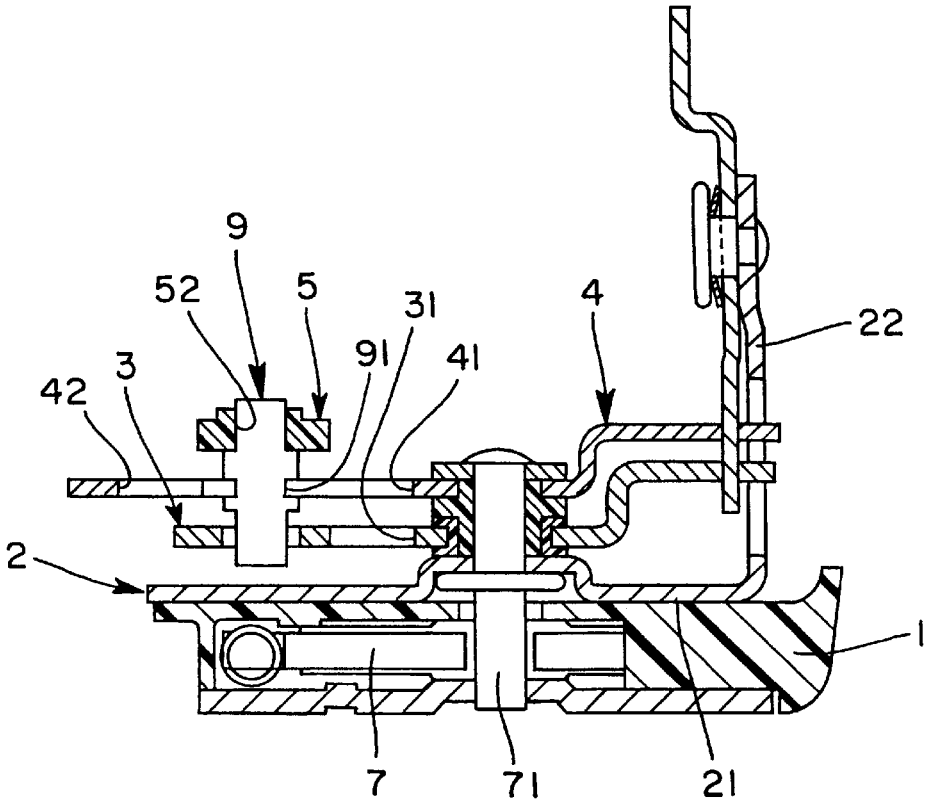
FIG. 3 is a cross sectional view along a line III—III in FIG. 1.

As shown in FIGS. 1 to 3, an L-shaped base bracket 2 having a horizontal wall 21 and a vertical wall 22 is fixed to a door lock body 1 adapted to be fixed to a vehicle door (not shown) and receiving a latch 6 and a pawl 7 (FIGS. 4 and 5) therein as mentioned below, and a lift lever 3, a door opening lever 4 and a locking lever 5 are arranged as illustrated on the horizontal wall 21 of the base bracket 2.

Figure 4:
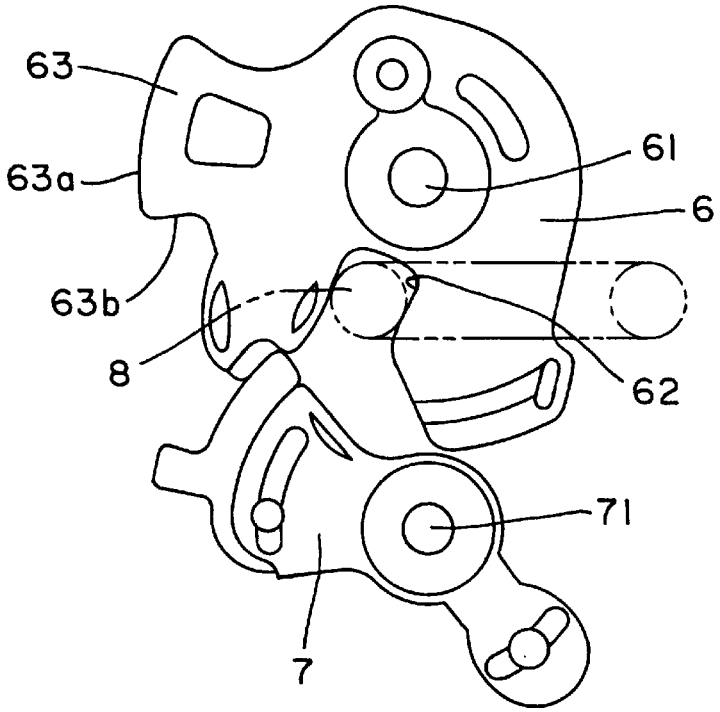
FIG. 4 is a schematic view which shows a door close state due to an engagement between a latch and a pawl of the door lock assembly for a vehicle in accordance with the invention.
Figure 5:
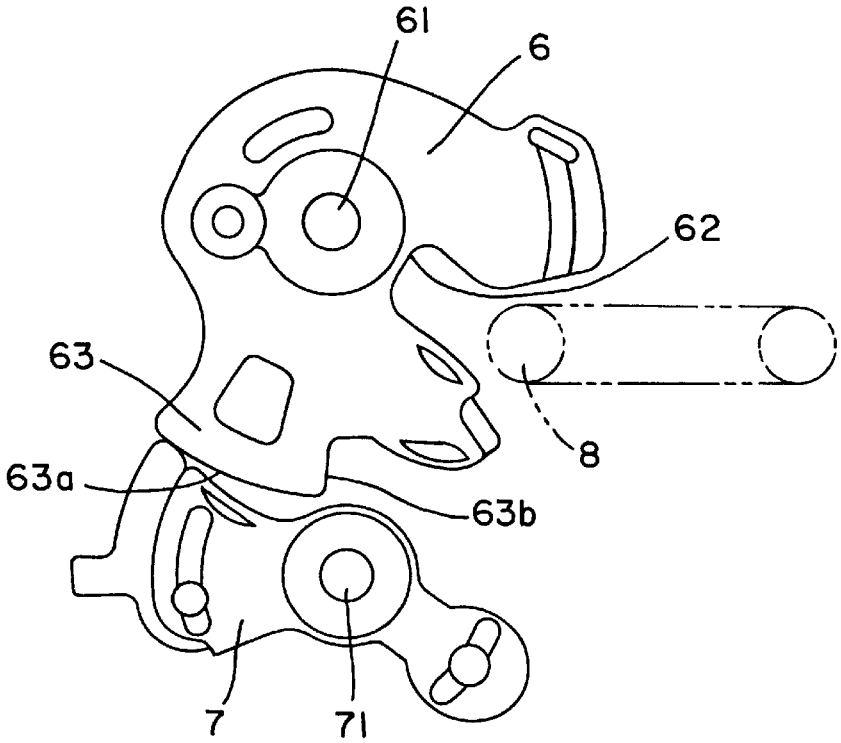
FIG. 5 is a schematic view which shows a door open state due to an engagement between a latch and a pawl of the door lock assembly for a vehicle in accordance with the invention.

As shown in FIGS. 4 and 5, the latch 6 is rotatably supported to the door lock body 1 by a latch pin 61, and the pawl 7 is rotatably supported to the door lock body 1 on the same plane as that of the latch 6 by a pawl pin 71. The latch 6 can be relatively engaged with and disengaged from the pawl 7. Further, a U-shaped groove 62 for receiving a striker 8 fixed to a vehicle body (shown by a phantom line) together with a close operation of the vehicle door is formed in the latch 6, and the vehicle door is kept in a closed state by an engagement of the pawl 7 and the latch 6 at a time of engaging the striker 8 with the latch 6 (a latch state is shown in FIG. 4). Further, an outward projecting projection 63 is formed on a peripheral surface of the latch 6, and a positional relation of the pawl 7 with respect to the latch 6 at a time of opening the vehicle door is defined by bringing a peripheral surface 63*a* of the projection 63 into contact with the pawl 7 (an unlatch state is shown in FIG. 5). In this case, a diametrical surface 63*b* of the projection 63 can be engaged with the pawl 7, and a half-closed state of the vehicle door can be obtained by this engagement.

As shown in FIGS. 1 to 3, the pawl pin 71 extends through the door lock body 1 and the horizontal wall 21 of the base bracket 2, and rotatably supports the lift lever 3 and the door opening lever 4 in a coaxial and layered manner. Further, the locking lever 5 is rotatably supported to the horizontal wall 21 by a pin 51. A window like opening 31 is formed at an end of the lift lever 3, and a pawl pin 32 which is connected to the pawl 7 is fixed to the other end thereof. A rotational motion of the lift lever 3 is transmitted to the pawl 7 through the pawl pin 32, and the pawl 7 is rotated in response to the movement of the lift lever 3. Accordingly, an engaging and disengaging relation between the pawl 7 and the latch 6 itself defines the positional relation of the lift lever 3 with respect to the door opening lever 4. A straight second oblong hole or supporting portion 41 which longitudinally extends is formed at an end of the door opening lever 4. The oblong hole 41 is overlapped with the window like opening 31 in the longitudinal direction. A first oblong hole 52 is formed in a circular arc shape on the locking lever 5 which is rotated about a pin 71 as a center. The first oblong hole 52 is disposed in such a manner as to be located substantially perpendicular to the second oblong hole 41.

A slide pin 9 is slidably supported with respect to the door opening lever 4 along a longitudinal direction of the oblong hole 41. The slide pin 9 is provided on an outer periphery with a groove 91, and the slide pin 9 is supported to the door opening lever 4 by inserting the slide pin 9 into the oblong hole 41 and fitting an edge of the oblong hole 41 into the groove 91. Further, the slide pin 9 is inserted into the window like opening 31 of the lift lever 3 at an end thereof (at a lower end in FIG. 3), and inserted into the oblong hole 52 of the locking lever 5 at the other end (at an upper end in FIG. 3). A through hole 42 communicating with an end of the second oblong hole 41 (an end of the one end of the door opening lever 4) is formed in the door opening lever 4. A diameter of the through hole 42 is set to be greater than a diameter of the slide pin 9, and the slide pin 9 is assembled with the door opening lever 4 by using the through hole 42, that is, at first the slide pin 9 is inserted into the through hole 42 and thereafter, is slid in a direction toward the oblong hole 41 so as to fit the edge of the oblong hole 41 into the groove 91.

The window like opening 31 of the lift lever 3 having a flange for increasing the rigidity thereof indicates a rectangular shape in a longitudinal direction and a width direction of the lift lever 3, and a projection 31*a* projecting toward an opening space of the window like opening 31 is formed substantially at the center portion of a side surface along a longitudinal direction (an upper side surface shown in FIG. 1). Further, a front end of the lift lever 3 from the projection 31*a* in the other side surface (a lower side surface in FIG. 1) opposing to the one side surface constitutes a horizontal surface 31*b* capable of bringing contact with the slide pin 9 at a time of rotation of the door opening lever 4 at a predetermined angle, and further, the opposing end thereof constitutes a recess surface 31*c* which can not be brought into contact with the slide pin 9 at a time of rotation of the door opening lever 4 at a predetermined angle. The projection 31*a* is positioned on a slide track of the slide pin 9 along the second oblong hole 41 of the door opening lever 4 or comes out of the slide track or stroke of the slide pin 9 in correspondence to the positional relation for rotation of the lift lever 3 with respect to the door opening lever 4, with the positional relation being defined by the engaging and disengaging relation between the pawl 7 and the latch 6.

A pair of leg portions 53 and 54 is formed on the locking lever 5 in an extending manner. Further, a stopper body 23 positioned between both the leg portions 53 and 54 of the locking lever 5 is mounted to the horizontal wall 21 of the base bracket 2. The locking lever 5 is constructed such as to rotate between a state in which the leg portion 53 and the stopper body 23 are brought into contact with each other and a state in which the leg portion 54 and the stopper body 23 are brought into contact with each other, and slides the slide pin 9 along the second oblong hole 41 of the door opening lever 4 by the rotating motion of the locking lever 5. In a state that the leg portion 53 of the locking lever 5 and the stopper body 23 are brought into contact with each other, the slide pin 9 is disposed at a position of moving in such a manner as to be brought into contact with the horizontal surface 31*b* of the window like opening 31 of the lift lever 3 due to the rotating motion of the door opening lever 4 (an unlock state wherein the latch mechanism 6 and 7 can be actuated to open the door through an operation of the opening lever 4), and in a state that the leg portion 54 of the locking lever 5 and the stopper body 23 are brought into contact with each other, the slide pin 9 is disposed in such a manner as to be positioned within the recess surface 31*c* of the opening 31 of the lift lever 3 due to the rotating motion of the door opening lever 3 (a lock state wherein the latch mechanism 6 and 7 can not be actuated through the operation of the opening lever 4). A turn over spring 24 is provided for holding the locking lever 5 in a state that the leg portion 53 and the stopper body 23 are brought into contact with each other and in a state that the leg portion 54 and the stopper body 23 are brought into contact with each other. In this case, the through hole 42 of the door opening lever 4 is disposed out of the slide range of the slide pin 9 with respect to the door opening lever 3 defined by a contact between the leg portions 53 and 54 of the locking lever 5 and the stopper body 23, and is constructed such that the slide pin 9 is not accidentally positioned within the through hole 42 by the locking lever 5 after assembling the slide pin 9. Further, the first oblong hole 52 of the locking lever 5 allows the slide pin 9 to move at a time of rotating the door opening lever 3.

Next, an operation of the door lock assembly will be described below.

FIG. 1 shows the unlock state wherein the latch mechanism 6 and 7 can be actuated to open the door through an operation of the opening lever 4 of the door, but in the latch state of the latch 6 and the pawl 7 (a close state of the vehicle door) as shown in FIG. 4. At this time, since the pawl 7 integrally rotating with the lift lever 3 engages with the latch 6, the slide pin 9 is disposed substantially at a center between a side surface (upper side surface in FIG. 1) of the window like opening 31 of the lift lever 3 and the horizontal surface 31*b* extending in a width direction of the lift lever 3, as shown in FIG. 6, and further, the projection 31*a* of the opening 31 is positioned out of the slide track of the slide pin 9 along the oblong hole 41 of the open lever 4, thereby making it possible to perform a slide motion of the slide pin 9 along the oblong hole 41 of the door opening lever 4.

Figure 6:
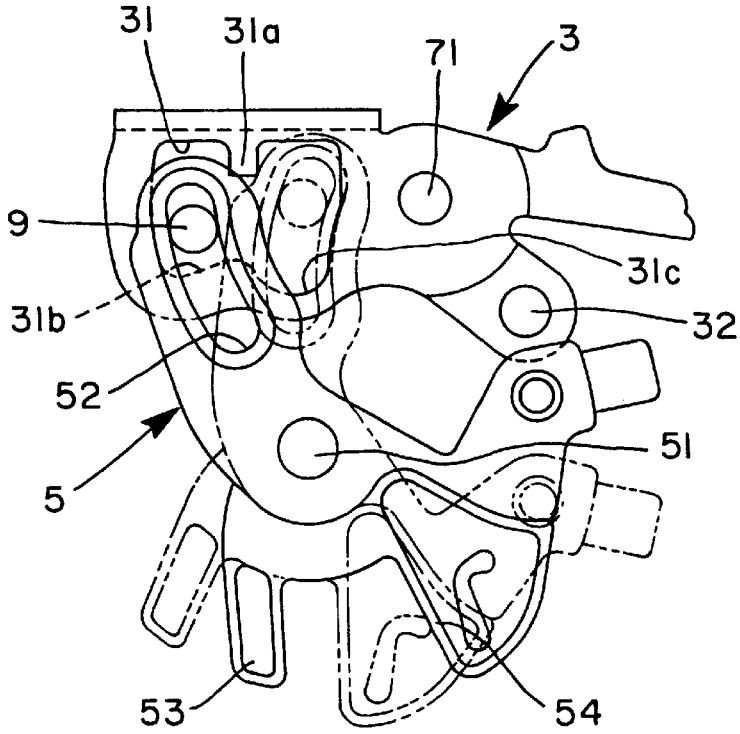
FIG. 6 is a schematic view which shows an arrangement of each of levers in a door close state of the door lock assembly for a vehicle in accordance with the invention.

In a state shown in FIGS. 1, 4 and 6, when the door opening lever 4 is rotated counterclockwise (in FIG. 1) by operating an inside handle (not shown) disposed within the vehicle cabin or an outside handle (not shown) disposed out of the vehicle cabin, the slide pin 9 moves in a downward direction shown in FIG. 6 along the first oblong hole 52 of the locking lever 5 so as to press the horizontal surface 31*b* of the window like opening 31 of the lift lever 3. Accordingly, the lift lever 3 rotates counterclockwise (in FIG. 1) together with the door opening lever 4 through the slide pin 9, and the pawl 7 rotates in a counterclockwise direction shown in FIG. 4 together with the lift lever 3 in one united body through the pin 32. As a result, an engagement between the pawl 7 and the latch 6 is released and the latch 6 rotates in a counterclockwise direction shown in FIG. 4, so that an engagement between the latch 6 and the striker 8 is released so as to become an unlatch state (an open state of the vehicle door) as shown in FIG. 5. At this time, since a peripheral surface 63*a* of the projection 63 of the latch 6 and the pawl 7 are brought into contact with each other so as to restrict a rotation in a return direction (a clockwise direction shown in FIG. 5) opposite to the rotation of the pawl 7 mentioned above, the slide pin 9 is positioned in such a manner as to be brought into contact with the one side surface of the window like opening 31 of the lift lever 3, as shown in FIG. 7, by removing the rotational motion of the door opening lever 4, and the projection 31*a* of the opening 31 is positioned on the slide track of the slide pin 9 along the oblong hole 41 of the door opening lever 4, thereby restricting the slide motion of the slide pin 9 along the oblong hole 41.

In a state shown in FIGS. 1, 4 and 6, when the locking lever 5 is rotated in a clockwise direction shown in FIG. 6 by operating a lock knob (not shown) disposed within the vehicle cabin or a key cylinder (not shown), the slide pin 9 is slid along the second oblong hole 41 of the door opening lever 4 as shown in a phantom line in FIG. 6 from a position opposing to the horizontal surface 31*b* of the opening 31 in the lift lever 3 shown by a solid line in FIG. 6 so as to oppose the recess surface 31*c* of the opening 31 in the lift lever 3. Accordingly, even when the door opening lever 4 is rotated in the manner mentioned above, the slide pin 9 only moves to a downward position shown in FIG. 6 in such a manner as to be positioned within the recess surface 31*c* of the opening 31 in the lift lever 3, and the lift lever 3 is not rotated together with the door opening lever 4 as mentioned above, thereby being in a lock state wherein the latch mechanism 6 and 7 can not be actuated through an operation of the opening lever 4.

In an unlock state and the unlatch state (the open state of the vehicle door) of the pawl 7 and the latch 6 as shown in FIG. 5, and in the case that the locking lever 5 is rotated in the same manner as that mentioned above, the slide pin 9 is brought into contact with the projection 31*a* of the opening 31 in the lift lever 3, so that a slide motion along the oblong hole 41 of the door opening lever 4 is restricted. Accordingly, it is prevented to accidentally become a lock state in the open state of the vehicle door.

Figure 7:
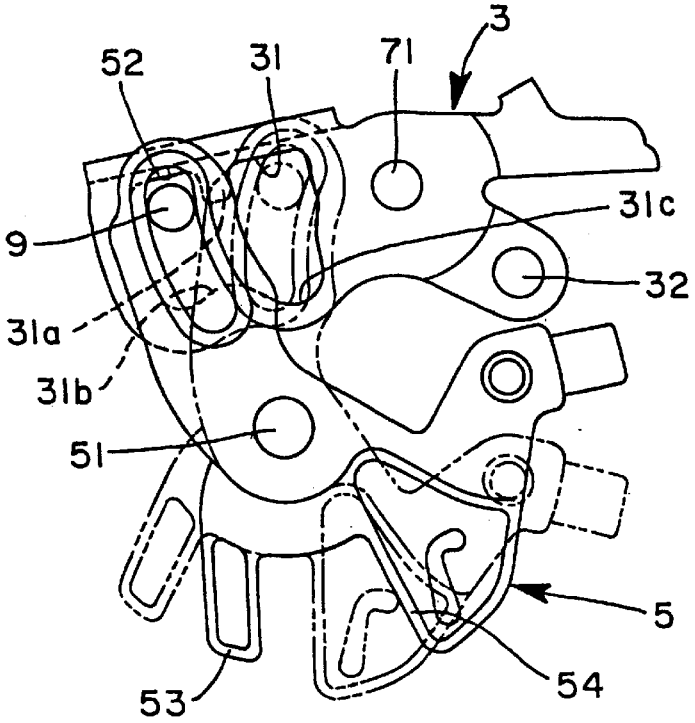
FIG. 7 is a schematic view which shows an arrangement of each of levers in a door open state of the door lock assembly for a vehicle in accordance with the invention.
Figure 8:
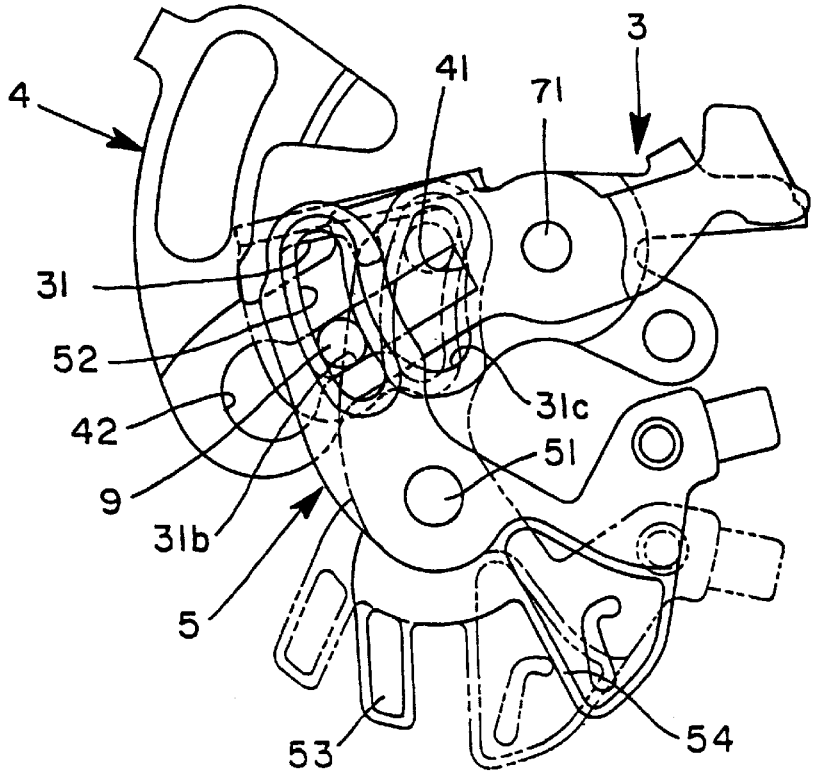
FIG. 8 is a schematic view which explains a key less lock operation of the door lock assembly for a vehicle in accordance with the invention.

In the unlock state and the unlatch state (the open state of the vehicle door) of the pawl 7 and the latch 6 as shown in FIG. 5, and in the case that the locking knob within the vehicle cabin is operated to be in a lock state and the vehicle door is turned to the close state from the open state (so-called a keyless lock), before rotating the locking lever 5 in the same manner as mentioned above, the outside handle disposed out of the vehicle cabin or the inside handle within the vehicle cabin is operated so as to previously rotate the door opening lever 4 as mentioned above, thereby moving the slide pin 9 to a lower position shown in FIG. 7. Accordingly, as shown in FIG. 8, the projection 31*a* of the opening 31 in the lift lever 3 becomes in a state of being removed from the slide track of the slide pin 9, as a result, the slide pin 9 is slid along the oblong hole 41 of the door opening lever 4 together with the rotational motion of the locking lever 5 so as to become a lock state.

In accordance with the invention, since the slide pin is supported to the door opening lever, and because the first oblong hole receiving the slide pin is formed in the locking lever, the opening receiving the slide pin and provided with the projection which can restrict the slide motion of the slide pin is formed in the lift lever, the link for connecting the slide pin and the locking lever which is necessary in the conventional art, is not required, so that the number of parts can be reduced and the door lock assembly for the vehicle having a simple structure can be provided in such a manner as to be advantageous in cost and space. Further, since the structure is made such as to be inserted into the lift lever at an end of the slide pin and be inserted into the locking lever at the other end with holding the door opening lever therebetween, an inclination of the slide pin at a time of rotating the door opening lever or the locking lever can be prevented, thereby securing a certain motion of the slide pin.

Further, in accordance with the invention, since the slide pin is slidably supported by the second oblong hole formed in the door opening lever and the through hole communicating with the second oblong hole out of the rotating range of the locking lever is formed in the door opening lever, the slide pin can be supported to the second oblong hole by using the through hole, so that an assembling operability for the slide pin can be widely improved.

The invention has thus been shown and described with reference to a specific structure however it should be noted that the invention is in no way limited to the details of the illustrated structures but changes and modifications may be made without departing from the scope of the appended claims.

What is claimed is:

1. A door lock assembly for an automotive vehicle comprising:

a base member adapted to be fixed to a body of a vehicle door;

a latch mechanism provided in the base member for holding the vehicle door in a closed position, the latch mechanism including a latch and a pawl, said pawl being rotatably mounted on a pivot pin;

a manually actuable door opening lever rotatably mounted on the base member, said door opening lever being provided with a supporting portion;

a slide pin slidably supported along the supporting portion of the door opening lever, said slide pin being slidable along the supporting portion of the door opening lever between an unlocked position and a locked position;

a lift lever provided on the base member for rotational movement about the pivot pin, said lift lever being provided with an opening through which extends the slide pin, the opening in the lift lever defining the unlocked position and the locked position of the slide pin, the opening in the lift lever including means for restricting sliding movement of the slide pin along the supporting portion of the door opening lever and for allowing free movement of the slide pin, the lift lever being operatively connected with the pawl through an engage portion so that rotational movement of the lift lever is transmitted to the pawl to move the pawl between a door release position and a door latch position; and a locking lever mounted for rotational movement on the base member to effect a lock and unlock state of the vehicle door, said locking lever having an opening into which extends the slide pin;

said means of the lift lever allowing rotation of the lift lever when the door opening lever is operated to open the vehicle door at a state in which the pawl is engaged with the latch and the vehicle door is closed and preventing rotation of the lift lever when the door opening lever is operated to open the vehicle door at a state in which the locking lever is in a door lock position.

2. A door lock assembly for a vehicle according to claim 1, wherein said means of the lift lever comprises a projection extending from a side edge of the opening of the lift lever, a flat surface opposed to the side edge, and a recess continuous to the flat surface.

3. A door lock assembly for a vehicle according to claim 2, wherein the slide pin is slidably held along the supporting portion of door opening lever by opposed edges defining the supporting portion of the door opening lever.

4. A door lock assembly for a vehicle according to claim 3, wherein the supporting portion of the door opening lever is an oblong opening and the length of the oblong opening corresponds to a stroke of the slide pin.

5. A door lock assembly for a vehicle comprising a lift lever rotated by way of an opening lever to engage and disengage a pawl with a latch for establishing a door opening or door closing state, a locking lever for keeping and releasing a connection between said lift lever and a door opening lever, and being structured to restrict and allow operation of said locking lever in correspondence to an operation state of said door opening lever, a slide pin slidably supported to said door opening lever, a first oblong hole formed in said locking lever and in which is positioned said slide pin, an opening formed in said lift lever, said slide pin being positioned in the opening, said opening being provided with a projection for restricting sliding motion of said slide pin, a second oblong hole formed on said door opening lever and supporting said slide pin in such a manner that sliding motion of said slide pin with respect to said door opening lever is allowed within a rotational range of said locking lever, and a through hole formed in said door opening lever to communicate with said oblong hole and receiving said slide pin out of the rotational range of said locking lever, wherein a position of said slide pin with respect to said opening of the lift lever changes in correspondence to operation of said door opening lever and said locking lever, thereby engaging and disengaging said pawl with said latch, and keeping and releasing a connection between said door opening lever and said lift lever.

6. A door lock assembly for a vehicle comprising:

a base member adapted to be fixed to a body of a vehicle door;

a latch mechanism operable between a latched state to effect a closed position of the door and an unlatched state to effect an open position of the door;

a manually operable door opening lever rotatably mounted on the base member and provided with a first opening;

a slide pin mounted in the first opening of the door opening lever for sliding movement along the first opening between a locked position and an unlocked position;

a lift lever mounted on the base member for rotational movement about a pivot pin, said lift lever including a window into which the slide pin extends, said lift lever being operatively connected to the latch mechanism so that rotational movement of the lift lever is transmitted to the latch mechanism to operate the latch mechanism between the latched state and the unlatched state;

a locking lever mounted for rotational movement on the base member between a door unlock position and a door lock position to move the slide pin from the unlocked position to the locked position, the locking lever including a second opening into which the slide pin extends; and said window of said lift lever being provided with means for controlling movement of the slide pin from the unlocked position to the locked position so that when the latch mechanism is in the unlatched state and the locking lever is moved towards the locking position in the absence of manual operation of the door opening lever, the slide pin is prevented from moving to the locked position, and so that when the latch mechanism is in the unlatched state and the locking lever is moved towards the locking position while the door opening lever is being manually operated, the slide pin is permitted to move to the locked position.

7. A door lock assembly for a vehicle according to claim 6, wherein said means for controlling movement of the slide pin includes a projection extending from one side edge of the window towards an opposite side edge of the window, a flat surface provided on the opposite side edge of the window, and a recess extending from the flat surface.

8. A door lock assembly for a vehicle according to claim 6, wherein said first opening in the door opening lever includes opposed edges which hold the slide pin.

9. A door lock assembly for a vehicle according to claim 6, wherein the latch mechanism includes a pawl and a latch, said pawl being mounted on a pawl pin, said lift lever and said door opening lever being mounted on the pawl pin.

10. A door lock assembly for a vehicle according to claim 6, wherein said first and second openings are oblong openings.

* * * * *